United States Patent [19]

Yulkowski

[11] 3,973,289

[45] Aug. 10, 1976

[54] DOOR HINGE

[76] Inventor: Leon B. Yulkowski, 4390 Derry Road, Bloomfield Hills, Mich. 48013

[22] Filed: May 23, 1975

[21] Appl. No.: 580,531

[30] Foreign Application Priority Data

May 31, 1974 Germany ..... 2426630

[52] U.S. Cl. ..... 16/178; 16/135; 16/171; 16/150; 16/128 R

[51] Int. Cl.[2] ..... E05D 1/64

[58] Field of Search ..... 16/128 R, 135, 171, 16/149, 150, 163, 164, 165, 136, 178, 179; 49/41, 381, 382, 388, 398, 399, 383, 384; 160/210, 213, 229 R, 113, 130, 181, 185

[56] References Cited

UNITED STATES PATENTS

| | | | |
|---|---|---|---|
| 3,210,808 | 10/1960 | Creager | 16/178 X |
| 3,353,884 | 11/1967 | Chaffee et al. | 16/128 R X |
| 3,402,422 | 9/1968 | Baer | 16/128 R X |
| 3,422,488 | 1/1969 | Horstman | 16/165 |
| 3,516,114 | 6/1970 | Joyce | 16/150 |
| 3,633,316 | 1/1972 | Belser | 16/171 X |
| 3,718,943 | 3/1973 | Bustin | 16/178 |

*Primary Examiner*—G. V. Larkin
*Attorney, Agent, or Firm*—Cullen, Settle, Sloman & Cantor

[57] ABSTRACT

A door positioned adjacent a door frame or jamb has a hinge which comprises an elongated profile bracket mounted on the frame and extending over at least a part of the door height. Said bracket includes a leg with an extension on said leg having a first arcuate outer surface on one side and spaced therefrom a second arcuate inner surface of reduced radius. The door has along one edge a transversely arcuate bearing surface which cooperatively receives said first arcuate surface. A support mechanism on the door is spaced from said bearing surface and retainingly engages said second arcuate surface whereby the arcuate bearing surface of the door moves over said first arcuate surface and said support mechanism rotates over said second arcuate surface. The mounting of said profile bracket on said door frame or jamb includes a second extension on said leg opposite from and a mirror image of said first extension including corresponding first and second arcuate surfaces. The door frame or jamb along one edge has a transversely arcuate bearing surface and a support mechanism which is a mirror image of the door bearing surface and support mechanism whereby after the door has rotated substantially 90° with respect to the profile bracket, said door and profile bracket are adapted to rotate an additional 90° relative to said door frame.

21 Claims, 7 Drawing Figures

FIG. 1
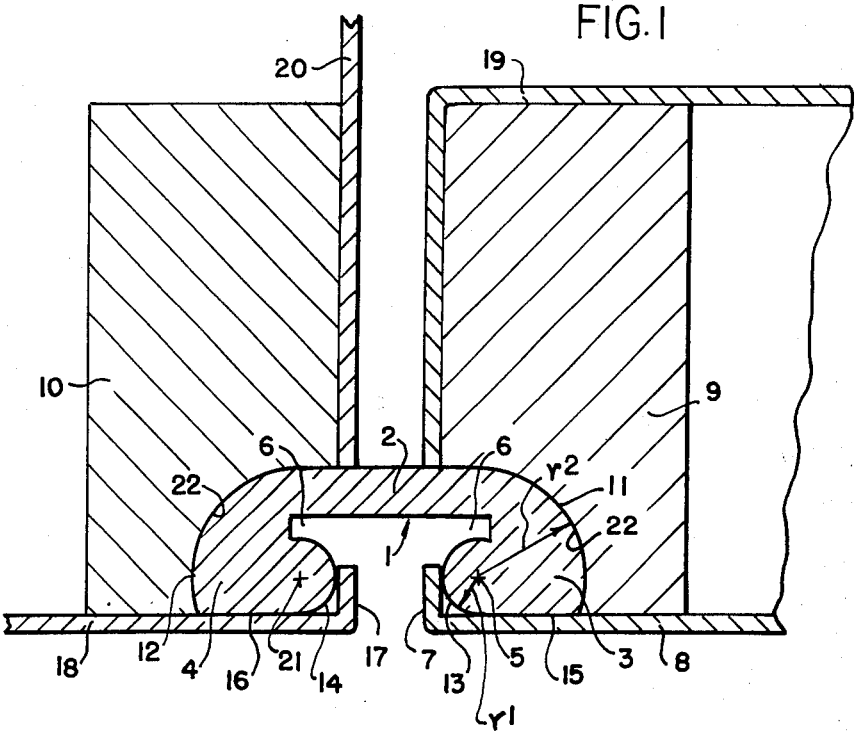
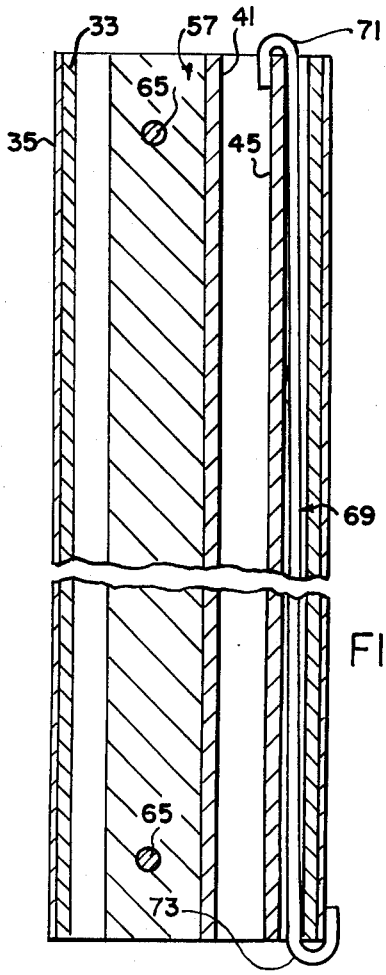
FIG. 3
FIG. 2
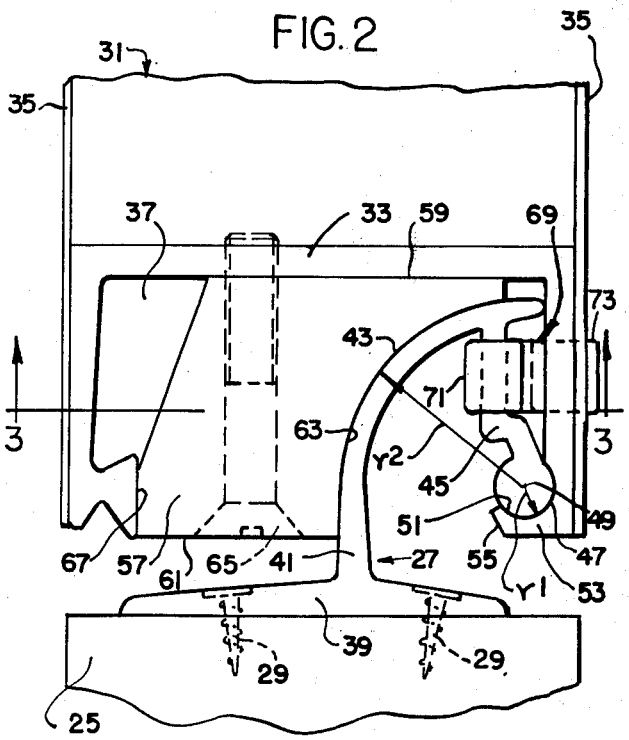

FIG. 5
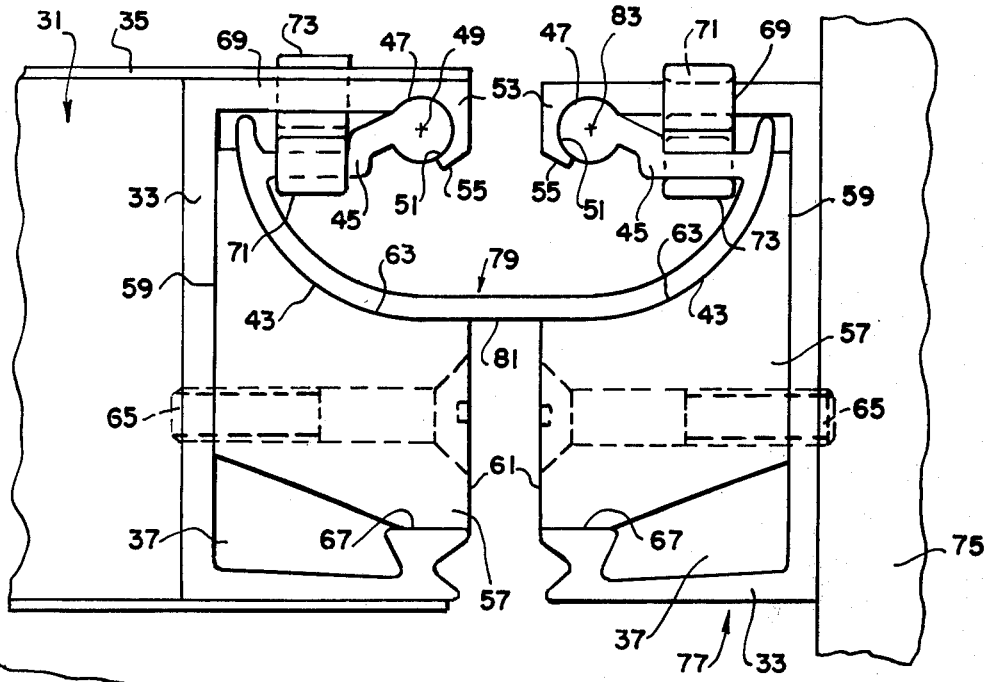
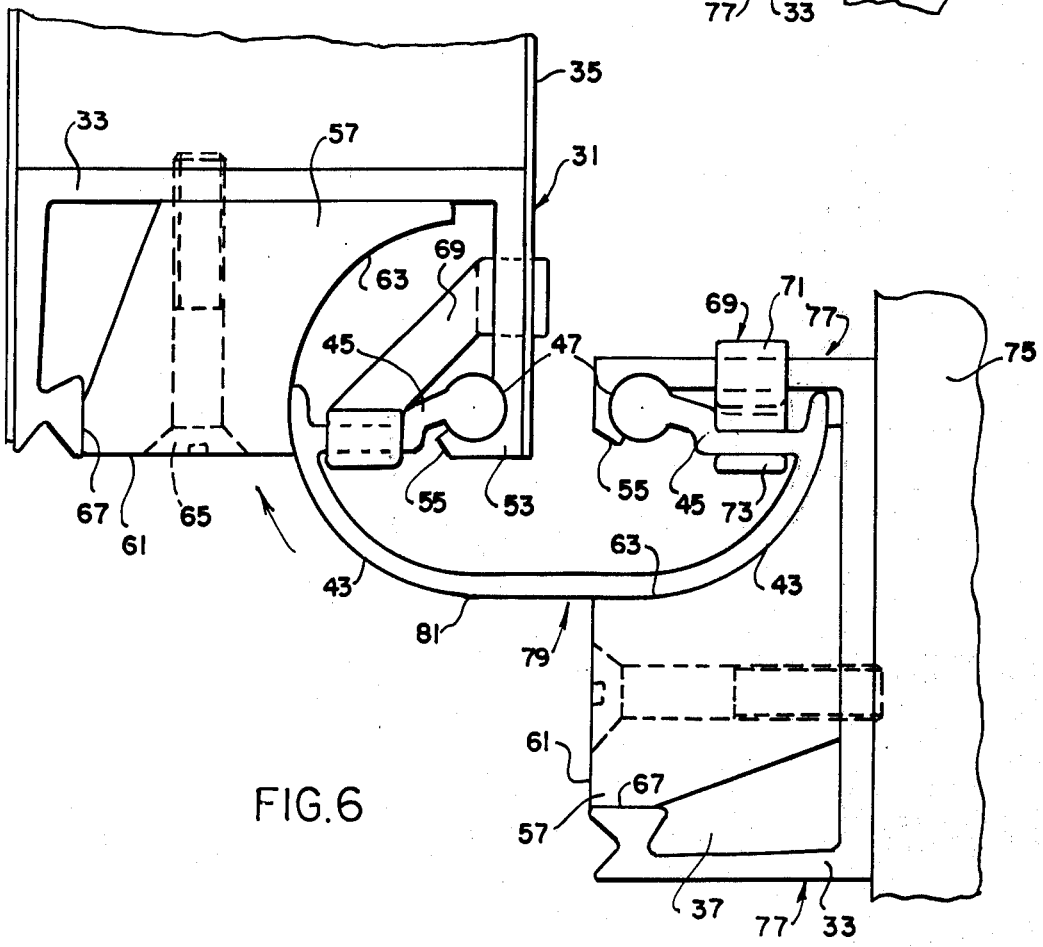
FIG. 6

DOOR HINGE

BRIEF DESCRIPTION OF THE INVENTION

Known door hinges consist mostly of two or more linkages arranged some distance from one another, with their one side attached to the door frame and with their other side attached to and carrying the door. For latching or bolting of such doors, openings are provided in the door frames in customary ways for spring loaded latch bolts and key operated deadbolts. Pressure brought to bear on such known doors concentrates pressure in the area of the hinges and in the area of the locks. Such doors are neither burglar proof nor are they able to withstand high loads, since by pressure, they can be easily sprung or removed from the hinges.

The present hinge provides an attractive easily manufacturable and mountable hinge. The hinge includes a bracket portion movably connected over at least a part of the door height and whose engaging elements are swingably and arrestably connected with a door. Pressure brought to bear on the hinge of such door is equally distributed over the height of the hinge so that the stress points which could have resulted in a breaking or prying open of the door are avoided.

It is an object of this invention to provide a simple and agreeably impressive door hinge which is able to withstand high loads. This object is achieved by means of a profile bracket extending at least over a part of the height of the door. The bracket is connected by a leg to the door frame or wall and has a profile on the door related side with an angular projection provided on opposing sides with arc formed curves with the same center and different radii. The door has a shaped slot of arc shape in crossection on the hinge side of the door. To open, the door swings about an axis of the profile bracket, which is established by the center point of the two radii. In order to prevent the door from shifting in an axial direction on the profile bracket and bear against the floor, a tension hanger is employed.

The curve with the greater radius of the profile bracket is outwardly situated, whereby an opening is provided between the inwardly positioned curve with the smaller radius and the bracket leg. This opening will receive that part of the door enclosing the profile part with the smaller radius when swinging. When opening the door, the hook formed member enclosing the smaller radius of the profile bracket swings into the opening.

The outer oriented curve of the profile bracket with the larger radius joins the bracket leg tangentially. Further, the inwardly oriented curve of the profile bracket with the smaller radius also tangentially joins the face surface of the bracket continuation parallel to the leg. The straight surfaces that join the curved enclosing parts of the profile bracket produce thereby a limiting stop for the swinging angle of the door.

In a further development of the hinge, there is on the part of the leg facing the wall or doorframe a mirror image of the extension of the leg already described for the connection to the door. This fits into a recess like the one provided on the door. The door can therefore swing from the side of the profile bracket connected to the door, as well as the side connected to the doorframe or wall and thus attains an angle of traverse of 180°.

The profile bracket can be made either of an extruded section of metal or plastic, or of an accordingly bent piece of sheet metal.

These and other objects will be seen from the following specification and claims in conjunction with the appended drawings.

THE DRAWINGS

FIG. 1 is a fragmentary plan section through the hinging part of the door with the adjacent parts of the door frame or the wall.

FIG. 2 is a fragmentary plan view of a modified profile bracket as mounted upon a doorframe or jamb and projecting into a corresponding channel of a door.

FIG. 3 is a fragmentary elevational section taken in the direction of arrows 3—3 of FIG. 2.

FIG. 5 is a fragmentary plan view of a modified profile bracket extending between a supporting channel on a door jamb and a corresponding channel on a door by which the door is capable of opening movements up to 180°.

FIG. 6 is a similar view showing the relative position of the door and profile bracket with respect to the jamb when the door has been swung open 90°.

DETAILED DESCRIPTION OF THE INVENTION

Figure 4:
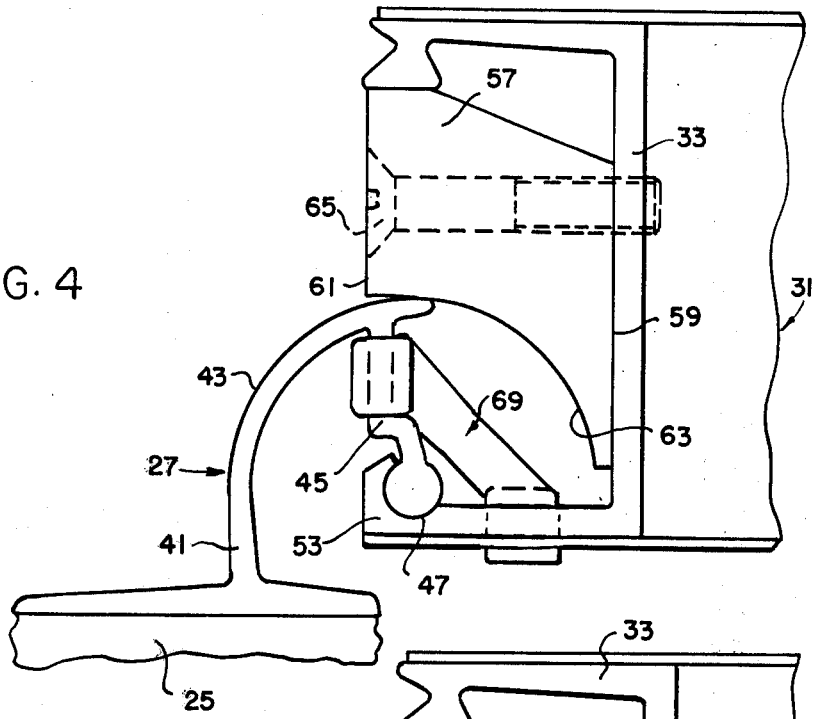
FIG. 4 is a plan view similar to FIG. 2 showing the relative position of the door to the profile bracket, when opened 90°.

The profile bracket generally indicated at 1 is the hinge. It consists in the double jointed example, of a middle leg 2 with curved extensions 3,4, on each end, which are mirror images of each other. The outer sides of the profile 11, 12 form an arc-shaped surface, while the two inner sides form the arc-shaped surfaces 13, 14. The inner radius of curvature *r*1 is smaller than the radius of the outer curvature *r*2. Both curved surfaces 11, 12 and 13, 14 have the same centers of curvature 5 and 21 which are also the points of position for the hinges.

The outer surface of the leg 2 is tangent to the two surfaces 11, 12. The two flat surfaces 15, 16 form the face sides of the extensions, and are parallel to leg 2. These flat surfaces are also tangent to the two inner curvatures 13, 14. Between the leg 2 and the two inner curvatures 13, 14 of the extensions 3, 4 a space 6 is provided.

On the parts of the wall or doorframe and door, facing each other, are the supporting member 9, 10 which have recesses 22 which are shaped so as to accept the outer curvatures 11, 12 of the profile bracket. The supporting members 9, 10 are connected to the door or doorframe as fragmentarily shown. They are enclosed by the plates 19, 20 and 8, 18. The plates 8, 18 are screwed on or attached by another means so that they bear a fixed relationship to the bracket, which nests in the recesses 22 of members 9, 10. The plates 8, 18 also have the parts 7, 17 which are braced against curvatures 13, 14 of the parts 3, 4 and thus retain the profile bracket. The height and thickness of the parts 7, 17 are regulated in such a way that when the door or profile bracket swings, they go into spaces 6.

To mount the profile bracket, one can also slide it into the recesses 22 of the members 9, 10 from above. Between the outer plates 7, 19 and 17, 30 of the door and the doorframe is a slot of such width that the leg 2 of the profile bracket which connects extensions 3, 4 can fit therethrough. The slot must also provide enough room for the parts 7, 17 to swing freely about the curvatures 13, 14 of the extensions 3, 4.

A hanger, as hereafter described, insures against longitudinal displacement between the bracket and members 9, 10

When the door is opened, the door swings first on the point of rotation 5 of extension 3 until the part 7 strikes the bottom of space 6 in bracket 1. With this action, the door is capable of being opened to approximately 90°. Opening the door further will cause the profile bracket to be turned on the point of rotation 21, thus allowing the door to be opened 180°. The pivoting motion along points of turning 5, 21 can take place at the same time, or, either one can follow the other.

The present profile bracket shown in FIG. 1 may be constructed of metal or plastic or sheet metal.

A modification is shown in FIGS. 2, 3 and 4 for a combination door and hinge for regulating 90° opening movements of the door with respect to a door frame or jamb.

The doorframe or jamb is fragmentarily indicated at 25, FIG. 2, with a profile bracket 27 mounted thereon by fasteners 29 which extend through its flange 39. Said bracket provides a hinge for the door, fragmentarily indicated at 31. Said door includes an outwardly opening channel 33, at least along one edge, adapted to receive the profile bracket 27. Said door is normally spaced from the door frame or jamb 25, and includes cover plates 35.

The channel 33 includes an upright opening 37 adapted to receive leg 41 of bracket 27. The leg 41 has a lateral extension which includes a first arcuate outer surface 43 on one side thereof, and upon its other side and spaced therefrom, a second arcuate inner surface 47 of reduced radius on the end of extension 45.

The radius of the second or inner arcuate surface is designated at *r*1, and the radius of the first arcuate surface is designated at *r*2. Both the first and second arcuate surfaces have a common center of curvature at 49.

Arcuate socket 51 is formed upon the laterally-inward extension 53 on channel 33 with the end of said extension defining a stop 55 adapted for registry with extension 45 when the door has been rotated to the 90° open position shown in FIG. 4. The support means or mechanism upon the door which receives the second arcuate surface 47 includes channel extension 53 and its socket 51.

In the embodiment described with respect to FIG. 1, there was shown at 22 a recess defining the transversely-arcuate bearing surface formed within the door edge adapted to cooperatively receive the first outer arcuate surface 11 of the leg extension 3.

In the embodiment shown in FIG. 2, this transversely arcuate bearing surface which forms a part of the door is defined within the door channel 33 by the elongated removable anchor strip 57 which is nested within recess 37 within said channel and has an inner flat surface 59 which engages the channel and an outer flat surface 61 which is substantially flush with the channel opening, FIG. 4.

A series of longitudinally spaced fasteners 65 project through the anchor strip and through corresponding portions of channel 33 to provide a means by which the profile bracket leg 41 and arcuate extension 43 may be first projected into the channel opening 37 and thereafter retained therein by the removable anchor strip 57.

Said anchor strip has upon one side along its height a transversely arcuate bearing surface 63 which corresponds to the bearing surface 22 of FIG. 1.

An inwardly directed stop flange 67 is opposed to the corresponding extension 53 of channel 33 and is adapted to supportably receive one side of anchor strip 57.

On opening movement of the door 31, the transversely arcuate bearing surface 63 moves along and around the corresponding first outer arcuate surface 43 of the leg extension to the position shown in FIG. 4.

As shown in FIG. 3, in order to prevent relative longitudinal movement of the door with respect to the profile bracket 27 there is provided an elongated hanger strap 69 which extends at least along a part of the height of the profile bracket and has at its upper end a reverse-turned hook 71 which extends over and is supportably mounted upon the top surface or through an intermediate portion of said bracket. The lower end of the anchor strap terminates in a reverse-turned hook 73 which extends under and supportably engages door 35. Hook 73 may supportably engage an intermediate portion of the door.

The present hanger strap will supportably mount the door against relative longitudinal movement with respect to the anchor bracket and for free swinging movement within the door frame or door jamb.

Figure 7:
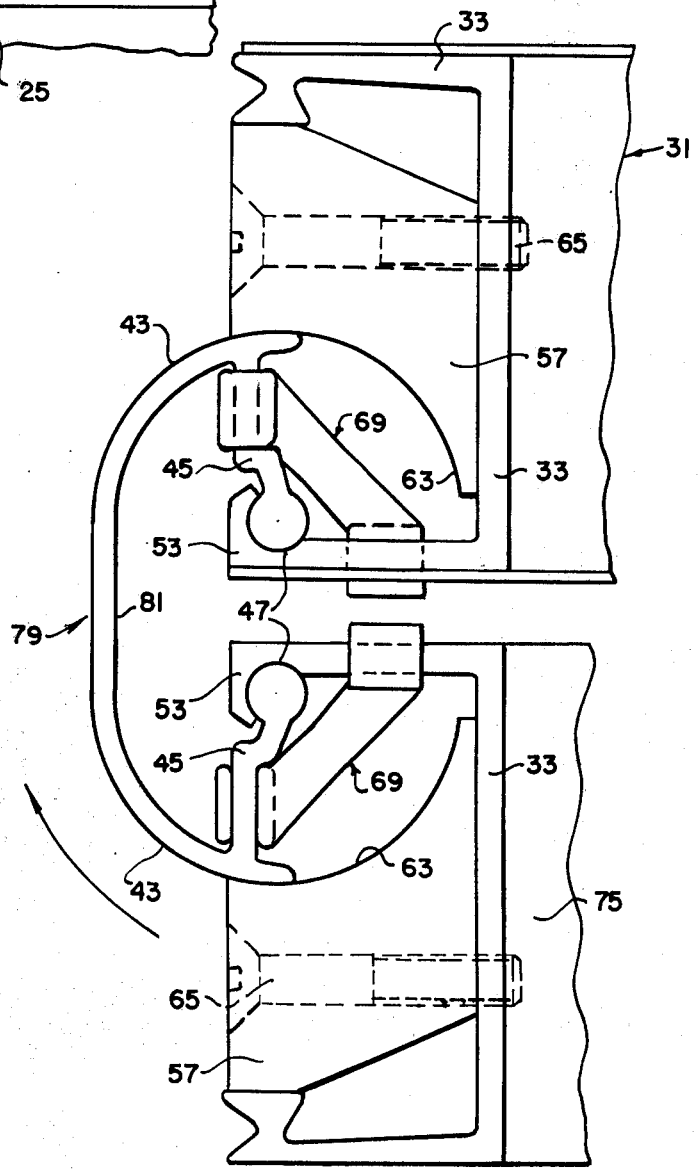
FIG. 7 is a similar fragmentary plan section illustrating the relative position of the door and profile bracket when swung 180° with respect to the door jamb.

A further modification is shown in FIGS. 5, 6 and 7. Here, the door jamb or frame 75 has an upright channel 33 which is the same construction as the opposing channel 33 within the door 31, described with respect to FIG. 2.

The profile bracket 79 is similar to the profile bracket in FIG. 1 and has an elongated leg 81 similar to leg 2 of FIG. 1 which is adapted to extend for at least a part of the height of the door. In many instances it will extend the full height of the door for closing the opening between channel frame 77 and door 35.

Leg 81 has a first extension with outer arcuate surface 43 and inner arcuate surface 47 the same as described with respect to FIG. 2. Leg 81 has a second opposed extension which is a mirror image of the first extension FIG. 5, already described in FIG. 2. Said second extension includes the first arcuate surface 43 and the spaced inner arcuate surface 47 upon the end of the extension 45 in a symmetrical construction.

In connection with the transverse bearing surface 22 of FIG. 1, the corresponding transverse bearing surface for the second extension on leg 81 is the same as the bearing surface 63 shown in FIGS. 2 and 4. It is defined by an additional anchor strip 57 which is the same construction as anchor strip 57 described with respect to FIG. 2.

In FIG. 5, the door is fragmentarily shown closed with respect to the jamb 75 also, and its corresponding channel frame 77. In FIG. 6, the door is shown rotated 90° from the position shown in FIG. 5, as it has rotated with respect to the profile bracket 79 and the door jamb. Here, also, the stop 55 on extension 53 has limited pivotal movement when it engages extension 45.

In FIG. 7, there has been an additional rotation of the door to the full 180° swing with respect to the door jamb. In this second rotation of 90°, the profile bracket has rotated with the door and with respect to the bearing surface 63 of the anchor strip 57 within the channel 33 on door jamb 75.

In FIGS. 5, 6 and 7, there are provided hanger straps 69 for suspending and mounting the door 35 against relative longitudinal movement with respect to profile bracket 81. Here the anchor strap is suspended from the profile bracket to support the door, as shown in FIG. 5 at the left.

An additional anchor strap 69 is provided except that here the upper hook portion 71 of the anchor strap extends over door frame channel 77 and the lower hook portion 73 supportably engages the profile bracket 81, preventing relative longitudinal movement between the profile bracket and the frame 77.

Suitable support means are employed for supporting the door against the relative longitudinal movement with respect to the profile bracket when the profile bracket is anchored. Additional and similar support means may be required for the profile bracket when it is not anchored. In the illustrative embodiment the hanger strap 69 is employed. Said strap may be suspended from intermediate the height of the profile bracket and can supportably connect to the door intermediate its height. End thrust bearings may be employed.

One advantage of the present construction is that the door may be easily installed and removed from the door frame without relative longitudinal movement, utilizing strip 57 FIG. 2.

Having described my invention, I claim:

1. In combination with a door positioned adjacent and spaced from a door frame or jamb, a hinge comprising an elongated profile bracket mounted on said frame and extending over at least a part of the door height;

said bracket including a leg projecting laterally thereof;

an elongated extension on said leg having a first arcuate outer surface on one side thereof and upon its other side and spaced therefrom a second arcuate inner surface of reduced radius;

said door having along one edge a transversely arcuate bearing surface of substantially the same radius as and cooperatively receiving said first arcuate surface;

said support means on said door spaced from said transversely arcuate surface and retainingly engaging said second arcuate surface; whereby, on opening movement of the door, its arcuate bearing surface moves over and along said first arcuate surface, and said support means rotates over and along said second arcuate surface.

2. In the door of claim 1, said first and second arcuate surfaces having a common center of curvature.

3. In the door of claim 1, said second arcuate surface being spaced from said leg defining a recess;

said support means on opening of said door moving into said recess, with maximum rotation of the door limited by engagement of said support means with said leg extension.

4. In the door of claim 1, said first arcuate surface being tangent to said leg.

5. In the door combination of claim 4, said extension having a flat outer surface substantially parallel to said leg, and tangent to and merging with said second arcuate surface.

6. In the door combination of claim 1, said support means including a plate on one side of the door with its free end portion inturned over the adjacent door edge and spaced from the door transversely arcuate bearing surface.

7. In the door combination of claim 1, the mounting of said profile bracket on said door frame including an elongated flange spaced from said extension coextensive with said leg in height;

and means securing said flange to said door frame or jamb.

8. In the door hinge combination of claim 1, the mounting of said profile bracket on said door frame or jamb including a second extension on said leg opposite from and a mirror image of said first extension including corresponding first and second arcuate surfaces;

said door frame or jamb having along one edge a transversely arcuate bearing surface and support means which is a mirror image of said door transversely arcuate bearing surface and support means;

whereby after the door has rotated substantially 90° with respect to said profile bracket, said door and profile bracket are adapted to rotate an additional 90° substantially relative to said door frame.

9. In the door hinge combination of claim 8, said door frame or jamb including an outwardly opening channel receiving the second extension of said leg;

said transversely arcuate bearing surface in said door frame or jamb being formed along the length of an anchor strip nested within said door frame channel along the height of said profile bracket;

and a retaining means securing said strip within said channel, for slidably retaining the second extension of the profile bracket within said door frame or jamb, said strip being substantially coextensive with said second extension and its first arcuate surface.

10. In the door hinge combination of claim 9, a tension support hanger strap extending along the height of said profile bracket with its upper end reverse-turned over the top of said door frame or jamb and with its lower end reverse-turned over the under surface of and supportably engaging said profile bracket.

11. In the door hinge combination of claim 9, a tension support hanger strap extending along said profile bracket with its upper end reverse turned over a portion of said door frame or jamb and with its lower end reverse turned under a portion of and supportably engaging said profile bracket.

12. In the door hinge combination of claim 11, a second tension support hanger strap extending along said profile bracket wiht its upper end reverse turned over a portion of said profile bracket and with its lower end reverse turned over a portion of and supportably engaging said door.

13. In the door hinge combination of claim 1, a tension support hanger strap extending along at least part of the height of said profile bracket, with its upper end reverse-turned over and suspended from the top of said bracket and with its lower end reverse-turned over the under surface of and supportably engaging the door.

14. In the door hinge combination of claim 1, said door including an outwardly opening channel receiving said leg and extension;

said transversely arcuate bearing surface being formed along the length of an anchor strip nested within said channel along the height of said profile bracket;

and fastening means securing said strip with said channel, said strip adapted for slidably retaining the profile bracket extension within said door, said strip being substantially coextensive with said extension and first arcuate surface.

15. In the door hinge combination of claim 14, said support means for said second arcuate surface being a part of and projecting inwardly from one side of said channel.

16. In the door hinge combination of claim 14, an elongated flange on said channel spaced from said support means retainingly engaging said strip.

17. In the door hinge combination of claim 14, a tension support hanger strip extending along at least a part of the height of said profile bracket with its upper end reverse-turned over and suspended from the top of said bracket and its lower end reverse-turned over the under surface of and supportably engaging the door.

18. In the door hinge combination of claim 1, support means interposed between said profile bracket and door for restraining said bracket and door against relative longitudinal movements.

19. In the door hinge of claim 1, said profile bracket extending substantially over the door height, spanning and closing off the space between said door and door frame.

20. In the door hinge of claim 1, a compression or tension support hanger strap extending along at least a part of the height of said profile bracket, with one end engaging said bracket and its other end engaging the door.

21. In the door hinge of claim 1, a support means extending along at least a part of the height of said profile bracket, at one end secured to said door frame or jamb and its other end supportably engaging said door.

* * * * *